US009689236B2

(12) United States Patent
George et al.

(10) Patent No.: US 9,689,236 B2
(45) Date of Patent: Jun. 27, 2017

(54) LINER HANGER

(71) Applicant: Steelhaus Technologies, Inc., Calgary (CA)

(72) Inventors: Grant George, Calgary (CA); Shane Sargent, Calgary (CA); Curtis Ring, Millarville (CA); Matthew McCarthy, Calgary (CA)

( * ) Notice: Subject to any disclaimer, the term of this patent is extended or adjusted under 35 U.S.C. 154(b) by 557 days.

(21) Appl. No.: 14/139,254

(22) Filed: Dec. 23, 2013

(65) Prior Publication Data

US 2014/0360717 A1 Dec. 11, 2014

Related U.S. Application Data

(60) Provisional application No. 61/745,755, filed on Dec. 24, 2012.

(51) Int. Cl.
*E21B 43/10* (2006.01)
*E21B 23/01* (2006.01)

(52) U.S. Cl.
CPC ..... *E21B 43/10* (2013.01); *E21B 23/01* (2013.01)

(58) Field of Classification Search
None
See application file for complete search history.

(56) References Cited

U.S. PATENT DOCUMENTS 4,180,132 A * 12/1979 Young ..... E21B 23/006 166/120
5,785,133 A * 7/1998 Murray ..... E21B 7/061 166/117.5
6,554,062 B1 * 4/2003 Dewey ..... E21B 7/061 166/117.6
2007/0089885 A1 * 4/2007 George ..... E21B 23/006 166/382

* cited by examiner

*Primary Examiner* — Caroline Butcher
(74) *Attorney, Agent, or Firm* — Richard D. Okimaw

(57) ABSTRACT

An apparatus for suspending a liner within a bore comprising a central tubular member and first and second sets of radially expandable arms. Each set of arms are expandable by corresponding longitudinally movable cones spaced apart along the tubular member. The apparatus further includes a seal located between the first and second sets of radially expandable arms and a selectably longitudinally compressible sleeve located between the first and second sets of radially expandable arms.

15 Claims, 11 Drawing Sheets

LINER HANGER

CROSS REFERENCE TO RELATED APPLICATION

This application claims priority to U.S. Provisional Patent Application No. 61/745,755, filed Dec. 12, 2012 entitled Liner Hanger.

BACKGROUND OF THE INVENTION

1. Field of Invention

The present invention relates to hydrocarbon well construction in general and in particular method and apparatus for removably setting a liner hanger within a well bore.

2. Description of Related Art

In hydrocarbon production, many wells include a main vertical bore and one or more horizontal bores extending therefrom. During preparation for production, liners are frequently located within each horizontal bore having valves and other associated production components therein. Such liners are commonly suspended from the vertical bore by liner hangers.

Conventionally, liner hangers are adapted to frictionally or otherwise engage the vertical bore or liner with one or more gripping element. One current difficulty with conventional liner hangers is that they are commonly set in place and are not thereafter able to be readily removed.

SUMMARY OF THE INVENTION

According to a first embodiment of the present invention there is disclosed an apparatus for suspending a liner within a bore comprising a central tubular member and first and second sets of radially expandable arms. Each set of arms are expandable by corresponding longitudinally movable cones spaced apart along the tubular member. The apparatus further includes a seal located between the first and second sets of radially expandable arms and a selectably longitudinally compressible sleeve located between the first and second sets of radially expandable arms.

The first and second cones may be selectably secured to the tubular member. The first and second cones may be selectably secured to the tubular member by shear pins.

Each of the first and second sets of radially expandable arms may extend from a common ring at proximate ends thereof. Each of the first and second sets of radially expandable arms may be expanded by pressing the corresponding cones under distal ends of the arms. Each of the first and second radially expandable arms may include a bracing sleeve extending from the proximate end of the arms and having a distal end adapted to engage the corresponding cone so as to prevent overexpansion of the arms.

The compressible sleeve may comprise a plurality of arms having end surfaces selectably engageable with a corresponding receptacle sleeve. The plurality of arms may extend longitudinally from a ring extending around the tubular member. The arms may extend towards the second set of radially expandable arms. The receptacle sleeve may extend from a location proximate to the second set of radially expandable arms. The receptacle sleeve may extend between first and second ends wherein the first end overlies end surfaces of the arms and wherein the second end is proximate to the cone corresponding to the second set of radially expandable arms.

The end surfaces of the arms may include teeth engageable with corresponding grooves in the sleeve. The end surfaces of the arms may be maintained in engagement with the sleeve by the central tubular member. The central tubular member may include a recess at a position therealong corresponding to a position at which the arms are desired to be released from engagement with the sleeve.

The seal may comprise a tubular seal element extending between first and second ends located around the central tubular member. The seal element may include end walls located around the first and second ends thereof. The end walls may overlap a portion of the seal element.

The first set of radially expandable arms may be slidable along the central tubular member from an initial position towards the second set of radially expandable arms. The second set of radially expandable arms may be secured to the central tubular member.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
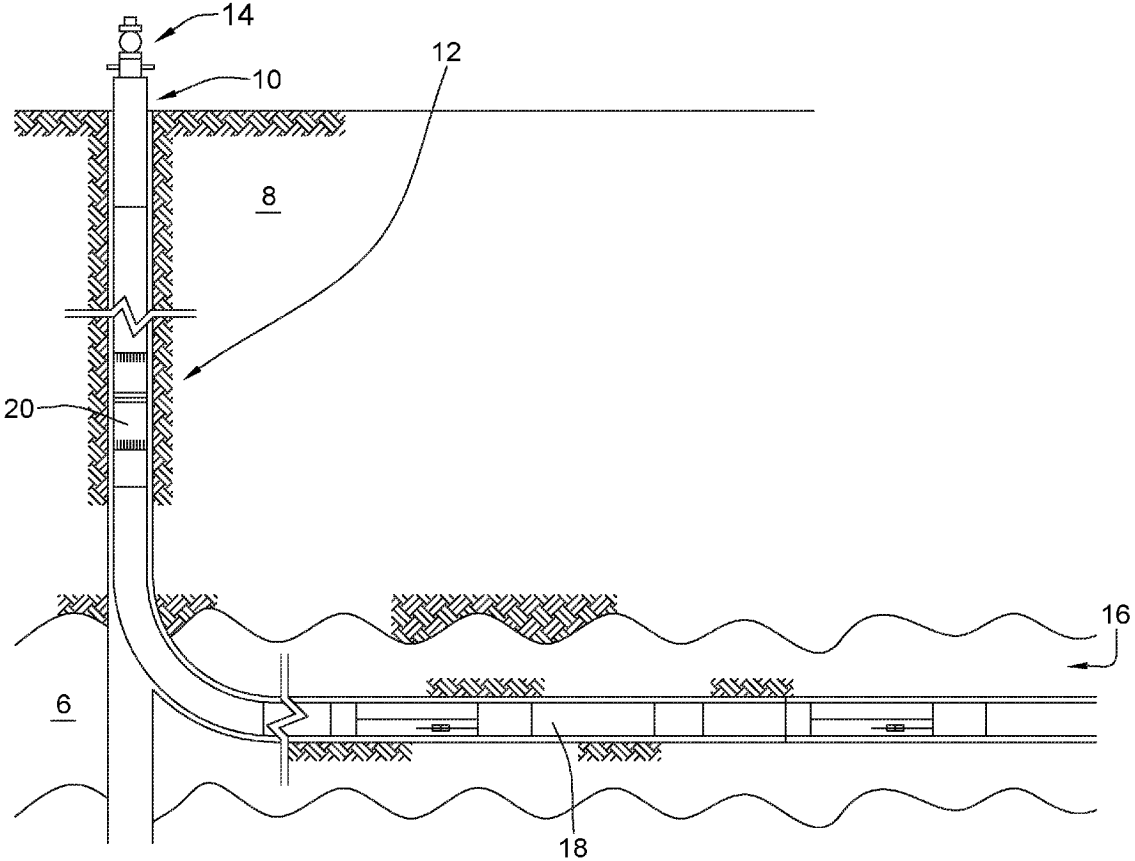
FIG. 1 is a cross-sectional view of a wellbore having a liner hanger according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the liner 18 is suspended therein from a liner hanger 20.

Figure 2:
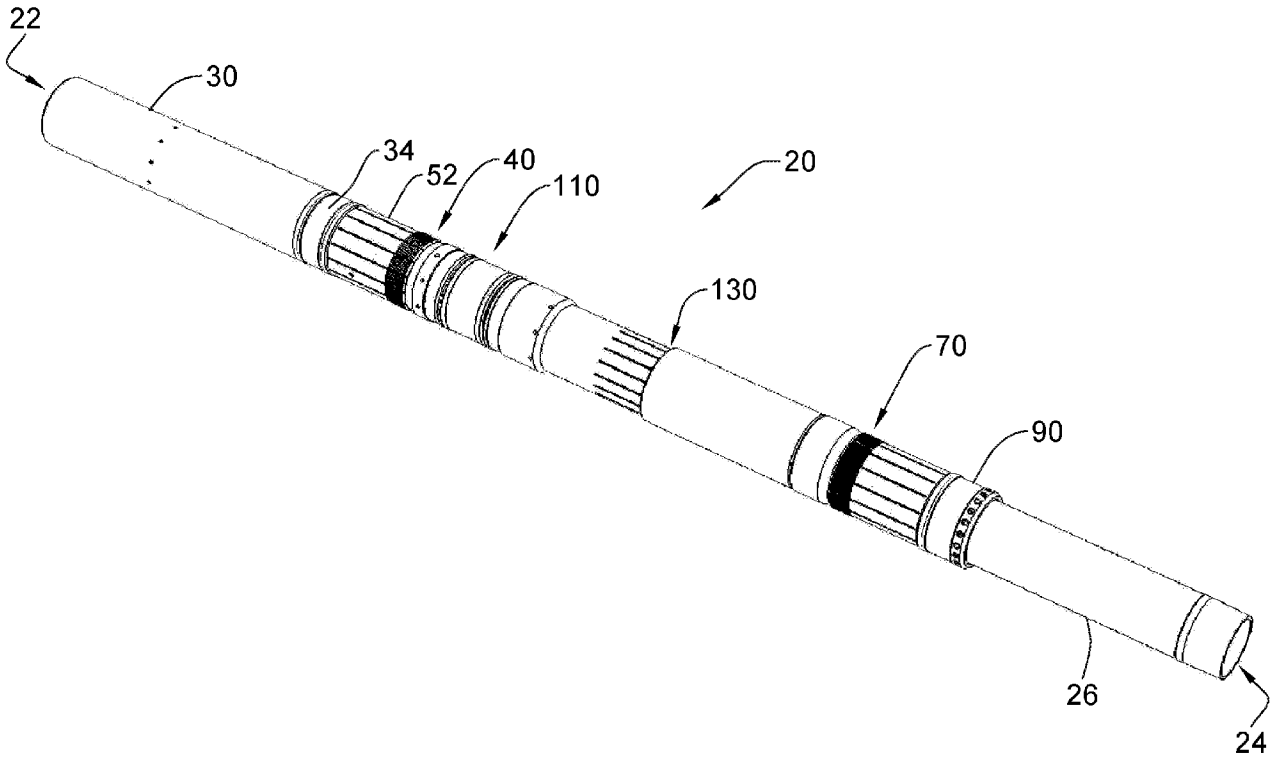
FIG. 2 is a perspective view of the liner hanger of FIG. 1.
Figure 3:
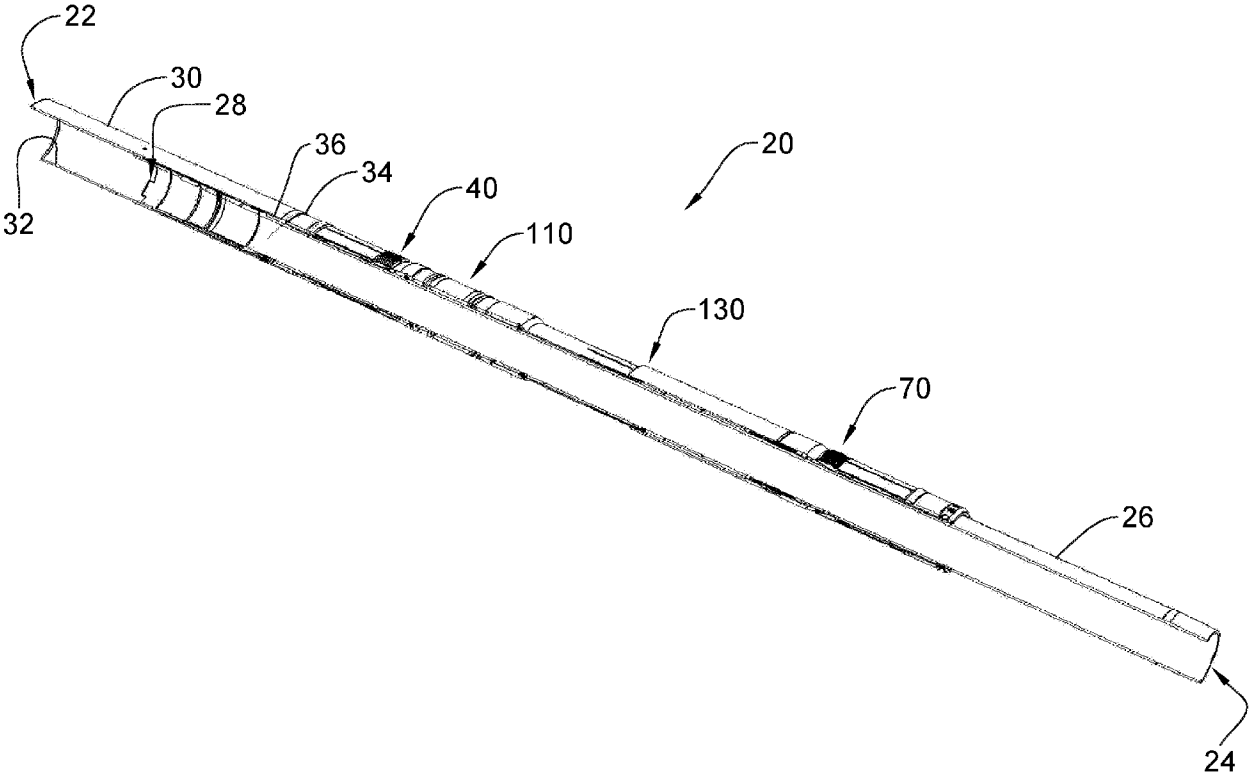
FIG. 3 is a longitudinal cross-sectional view of the liner hanger of FIG. 2 as taken along the line 3-3 in a first or retracted position.

With reference to FIGS. 2 and 3, a liner hanger according to a first embodiment of the present invention is illustrated generally at 20. The liner hanger 20 extends between first and second ends, 22 and 24, respectively, and is formed around a central tubular member 26. The tubular member 26 includes the second end 24 which is operable to have a liner 18 connected thereto according to known methods such as threading and the like. As illustrated the liner hanger 20 includes first and second collets, 40 and 70, respectively and a seal 110 therebetween.

The tubular member 26 may include a first end 28 having a threaded or other known end connector for connection to a production tubing, tool string or the like (not shown). The first end 22 of the liner hanger 20 also includes a setting sleeve 30 located therearound. The setting sleeve 30 is longitudinally slidable along the tubular member 26 such that the tubular member may be drawn in an upward direction towards the first end 22 of the liner hanger relative to the setting sleeve as will be more fully described below. The setting sleeve 30 extends between a threaded first end 32 for connection to a setting tool or the like, and an enlarged portion 36 at a second end thereof. Optionally, the setting sleeve 30 may also include separate hammer sleeve 34 threadably secured thereto which has an enlarged surface for engaging and extending the first bore engaging collets 40 as will be more fully described below.

Figure 4:
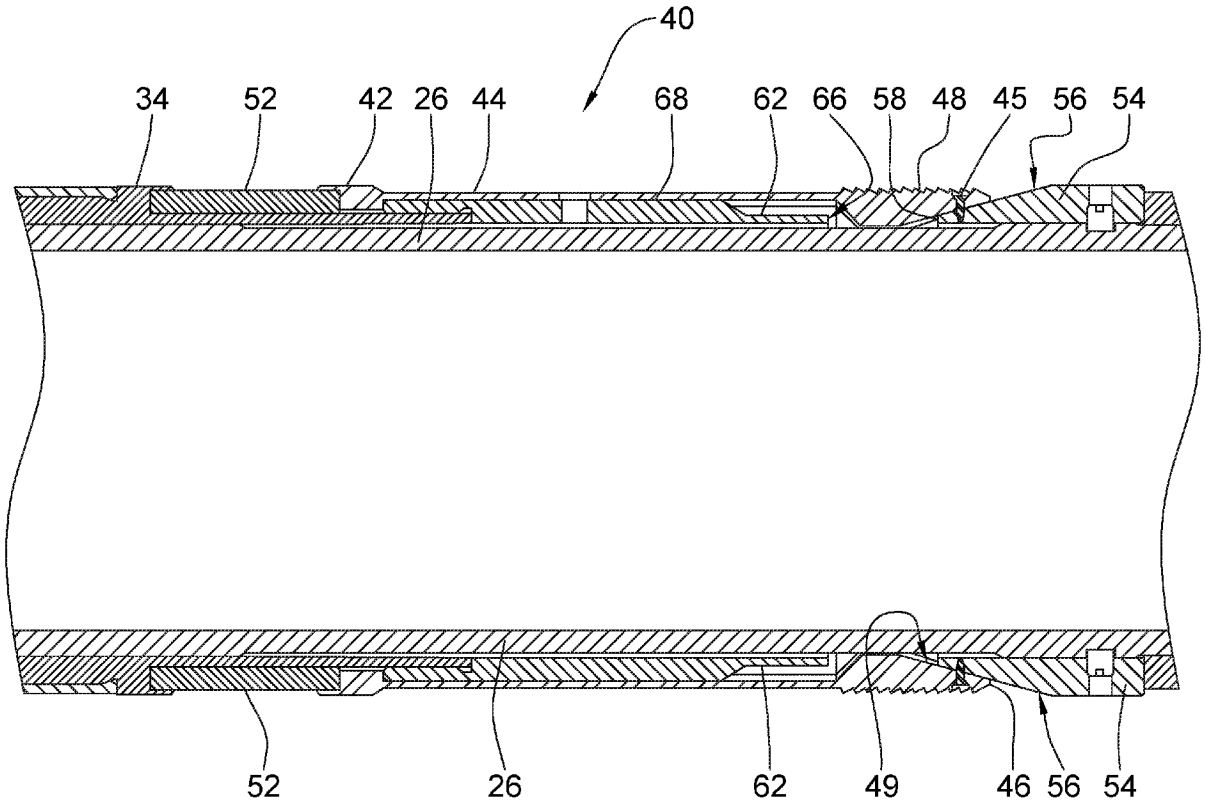
FIG. 4 is a detailed cross-sectional view of the first bore engaging arms of the liner hanger of FIG. 2 at a retracted position.

Turning now to FIG. 4, a detailed cross sectional view of the first collet 40 is illustrated. The first collet 40 comprises a common ring 42 having a plurality of longitudinally extending arms 44 extending therefrom in a direction generally towards the second end 24 of the liner hanger. The arms 44 have distal ends 46 having outwardly oriented bore engaging surfaces 48 as are commonly known and a bottom angled surface 49. As illustrated, the arms 44 extend substantially parallel to the tubular member and are separated from each other by slots 47 as illustrated in FIG. 2. The first collet 40 may also include a longitudinally compressible spring 52 located between the common ring 42 and the hammer sleeve 34 so as to prevent premature expansion of the arms 44 during run in and the like. The first collet 40 includes a first cone 54 associated therewith comprising a tubular body selectably secured to the tubular member with at least one shear pin 60. The first cone 54 includes an angled trailing surface 56 corresponding to the bottom surface 49 of the arms and ending at a trailing edge 58. The arms 44 may further secured to the first cone 54 by shear pins 45 so as to prevent extension of the arms during run in and the like.

Figure 5:
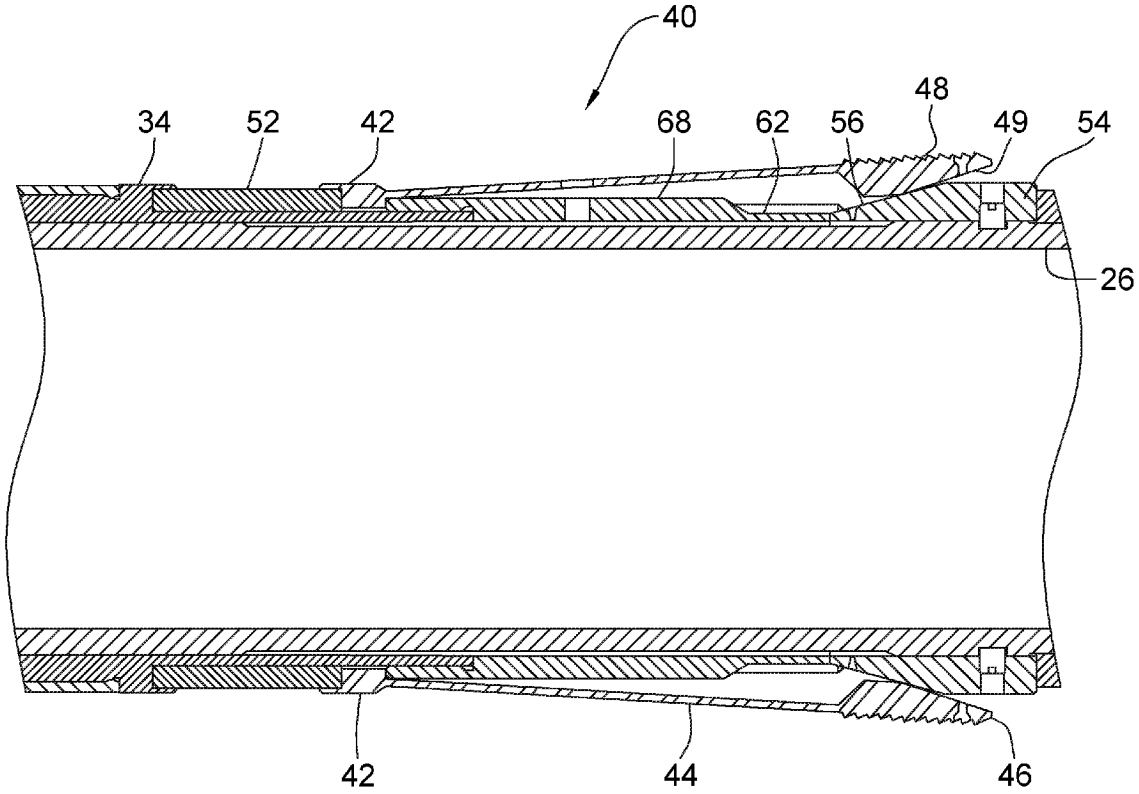
FIG. 5 is a detailed cross-sectional view of the first bore engaging arms of the liner hanger of FIG. 2 at an extended position.

The first collet 40 further includes a first bracing sleeve 62 located between the arms 44 and the tubular member 26. The first bracing sleeve 62 comprises a substantially tubular body extending between first and second ends 64 and 66, respectively and includes an enlarged portion having an upright surface 68 and a retracting surface 69 oriented towards the first end therealong. The first bracing may be threadably or otherwise secured to the hammer sleeve 34 so as to move longitudinally therewith. As illustrated in FIG. 5, as the tubular member 26 is drawn towards the first end 22 of the liner hanger, the first cone 54 is drawn into the first collet 40 so as to bear the angle surface 56 of the first cone against the angle bottom surface 49 of the arms 44 thereby biasing the arms 44 in a radially outward direction. Upon being extended by a predetermined distance, the trailing edge 58 of the first cone 54 will engage upon the second end 66 of the first bracing sleeve thereby preventing any further movement of the first cone relative to the arms 44 and thereby transferring any additional force exerted on the first cone 54 to the bracing sleeve 62. It will be appreciated therefore that the bracing sleeve 62 will prevent any of such excess force from bending or otherwise damaging the arms 44. At a predetermined activation pressure, the shear pins 60 are sheared thereby permitting the first cone 54 to remain fixed relative to the first collet 40 while the tubular member 26 is drawn therepast. In operation, the pressure at which the shear pins 60 are sheared may be selected to be any pressure, although it has been found that a force of between 5,000 and 30,000 pounds force has been useful.

Figure 8:
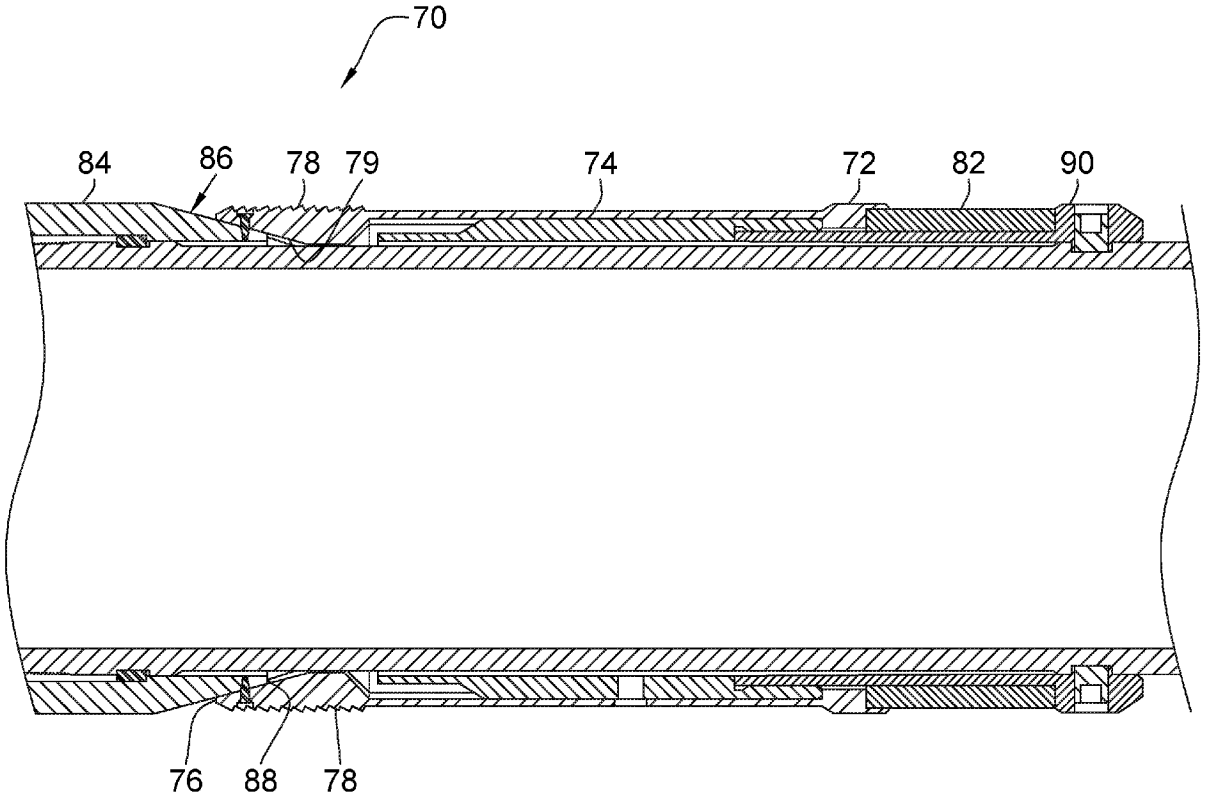
FIG. 8 is a detailed cross-sectional view of the second bore engaging arms of the liner hanger of FIG. 2 at a retracted position.
Figure 9:
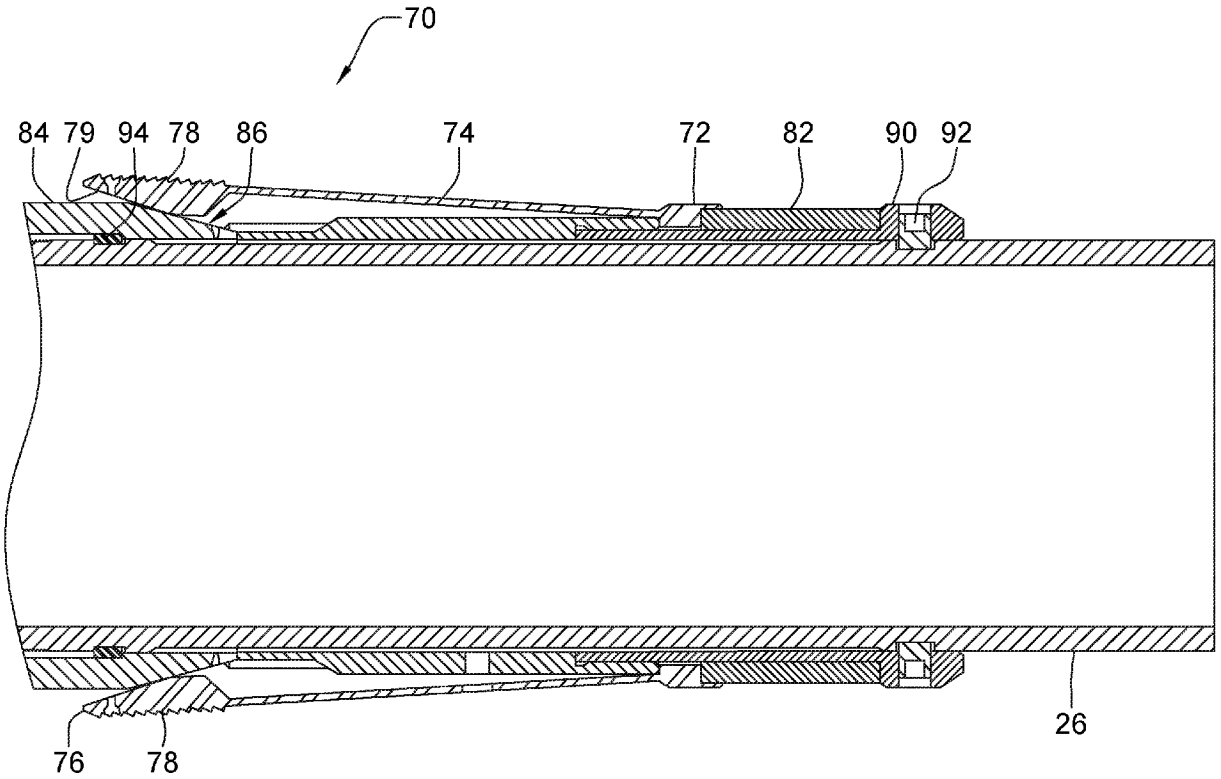
FIG. 9 is a detailed cross-sectional view of the second bore engaging arms of the liner hanger of FIG. 2 at an extended position.

Turning now to FIGS. 8 and 9, a detailed cross sectional view of the second collet 70 is illustrated. The second end 24 of the liner hanger 20 includes a shear sleeve 90 extending therearound which is selectably secured to the tubular member by at least one shear pin 92. The shear sleeve provides an end stop for the second collet and transmits movement of the tubular member 26 to the second collet 70. The second collet 70 comprises a common ring 72 having a plurality of longitudinally extending arms 74 extending therefrom in a direction generally towards the first end 22 of the liner hanger. The arms 74 have distal ends 76 having outwardly oriented bore engaging surfaces 78 as are commonly known and an inner angled surface 79. As illustrated, the arms 74 extend substantially parallel to the tubular member and are separated from each other by slots 77 as illustrated in FIG. 2. The second collet 70 may also include a longitudinally compressible spring 82 located between the common ring 72 and the shear sleeve 90 so as to prevent premature expansion of the arms 74 during run in and the like. The second collet 70 includes a second cone 84 associated therewith comprising a tubular body slidably located about the tubular body by a locating ring 94. The second cone 84 includes an angled leading surface 86 corresponding to the bottom surface 79 of the arms and ending at a trailing edge 88. The arms 74 may further secured to the second cone 84 by shear pins 83 so as to prevent extension of the arms during run in and the like.

The second collet 70 further includes a second bracing sleeve 96 located between the arms 74 and the tubular member 26. The second bracing sleeve 96 comprises a substantially tubular body extending between first and second ends 98 and 100, respectively and includes an enlarged portion having an upright surface 102 therealong. The second bracing sleeve 96 may be threadably or otherwise secured to the tubular member 26, such as within a depression as illustrated so as to move longitudinally therewith. As illustrated in FIG. 9, as the tubular member 26 is drawn towards the first end 22 of the liner hanger, the second collet 70 is drawn into the second cone 84 so as to bear the angle surfaces 79 of the arms 74 against the angled leading surface 86 of the second cone 84 thereby biasing the arms 74 in a radially outward direction. Upon being extended by a predetermined distance, the first end 98 of the second bracing sleeve 96 will engage upon the leading edge 88 of the second cone 84 thereby preventing any further movement of the first cone relative to the arms 74 and thereby transferring any additional force exerted on the cone 84 to the bracing sleeve 96. It will be appreciated therefore that the bracing sleeve 96 will prevent any of such excess force from bending or otherwise damaging the arms 74.

Figure 6:
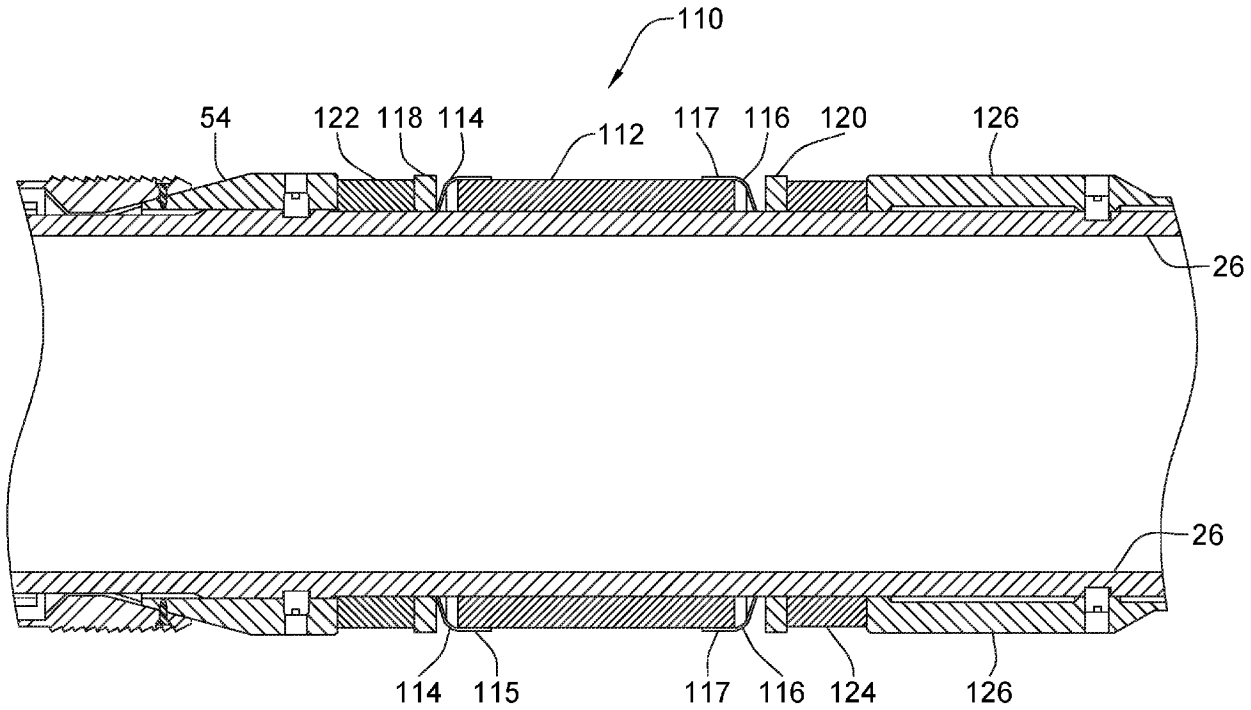
FIG. 6 is a detailed cross-sectional view of the sealing element of the liner hanger of FIG. 2 at a retracted position.

With reference to FIG. 6, the seal 110 comprises a tubular sealing element 112 located around the tubular member 26 between first and second extrusion barriers, 114 and 116, respectively. The seal 110 may be formed of any suitable compressible sealing element, such as, by way of nonlimiting example GraphicBraid™ produced by MinSeal™ of Tuscon Ariz. The extrusion barriers 114 and 116 comprise upright walls having an annular wall portion, 115 and 117, respectively located to overlay the sealing element 112.

The seal 110 also includes first and second bearing rings, 118 and 120, respectively having the sealing element 112 and extrusion barriers 114 and 116 therebetween as well as first and second compression springs 122 and 124, respectively located outside thereof. A backing ring 126 is secured to the tubular member 26 with backing ring shear pins 128 as illustrated in FIG. 10 and is located to an opposed side of the seal 110 from the first cone 54 which is operably connected to the second cone 84, through the compression joint, as further described below and is longitudinally displaceable along the tubular member 26 with the second cone.

Figure 7:
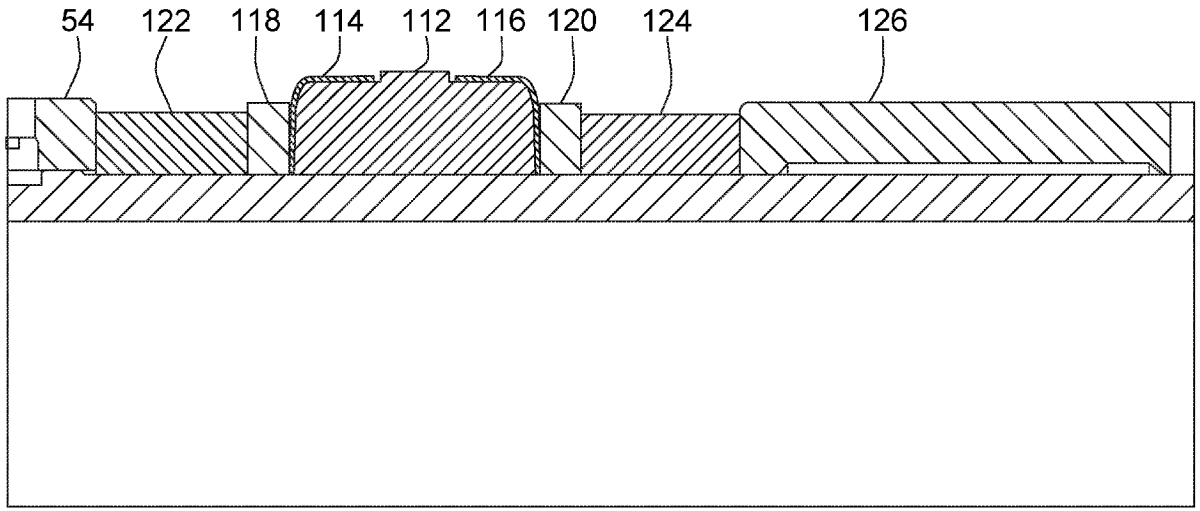
FIG. 7 is a detailed cross-sectional view of the sealing element of the liner hanger of FIG. 2 at an extended position.

In operation, as the tubular member is drawn in a direction generally towards the first end 22 of the liner hanger, backing ring 126 is drawn in a direction generally towards the first end 22 by the backing ring shear pins 128. In such movement, the first cone 54 is held stationary relative to the first collet 40 and setting sleeve 30 after the shear pins 60 have been sheared as set out above. During such movement, the backing ring 126 is moved towards the first cone 54 thereby compressing the first and second compression springs 122 and 124 and sealing element 112 as illustrated in FIG. 7. The extrusion barriers 114 and 116 will retain and guide the sealing element 112 to be extruded in a generally radially outward direction as illustrated. In such a manner, the tubular member 26 is drawn upwards relative to the setting sleeve 30 until the first and second collets 40 and 70 and sealing element 112 are engaged upon the inside of the bore thereby forming a secure sealed mounting location for liner located therebelow.

Figure 10:
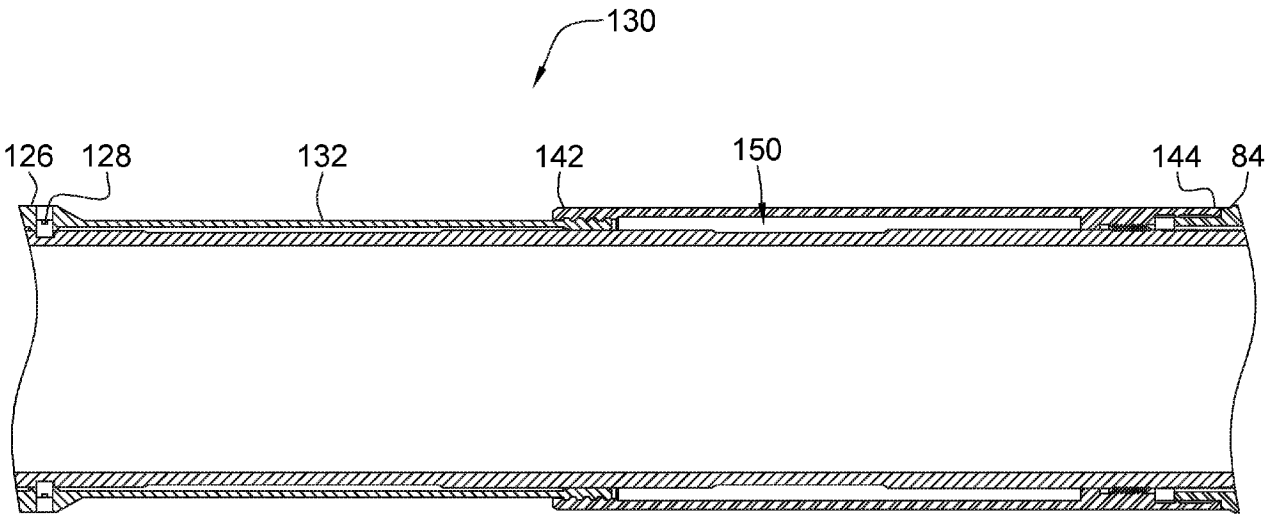
FIG. 10 is a detailed cross-sectional view of the compressible section of the liner hanger of FIG. 2 at an extended position.
Figure 11:
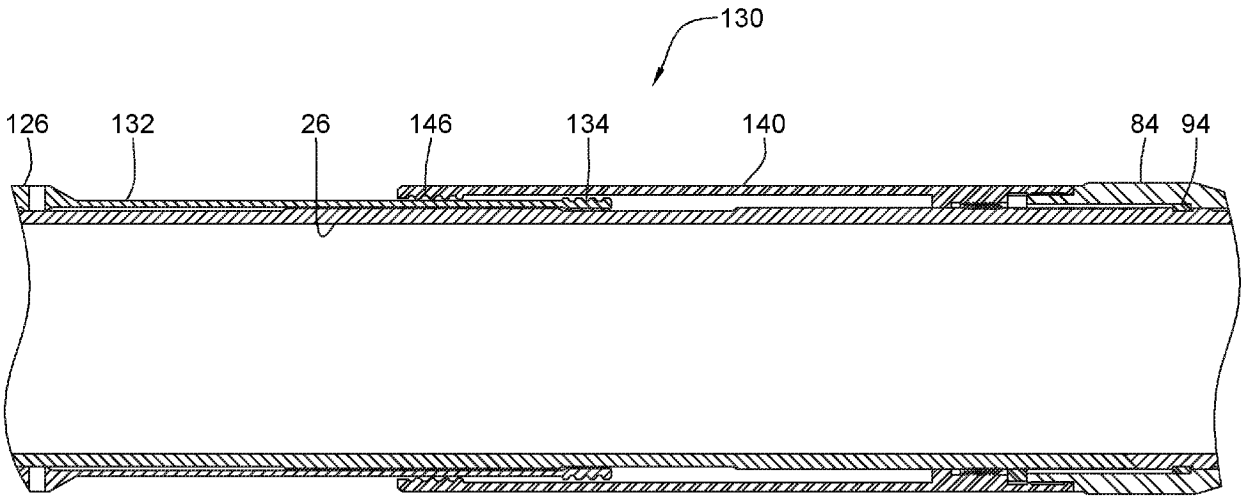
FIG. 11 is a detailed cross-sectional view of compressible section of the liner hanger of FIG. 2 at a compressed position.

With reference to FIGS. 10 and 11, a compressible section 130 may be located between the seal 110 and the second collet 70. The compressible section permits the distance between the seal 110 and the second collet 70 to be selectably reduced when the liner hanger is desired to be removed. The compressible section comprises a plurality of compression arms 132 extending substantially longitudinally from the backing ring 126 in a direction generally towards the second end 24 of the liner hanger. Each arm includes a plurality of teeth or grips 134 at a distal end thereof oriented radially outward.

The compressible section further includes a receptacle sleeve 140 between the arms 132 and the second cone 84. The receptacle sleeve 140 extends between first and second ends 142 and 144, respectively and includes a plurality of grooves 146 on an inner surface of the first end 142 corresponding to the teeth 134 at the end of the arms 132. The second end 144 of the receptacle sleeve 144 is secured to the second cone by threading or the like. In the first or operating position as illustrated in FIG. 10, the grooves 146 of the receptacle sleeve 140 are engaged with the teeth 134 of the arms so as to fix the relative positions therebetween. The arms are retained in a position so as to lock the teeth 134 therein by the tubular member 26 bearing against the bottom surface thereof. As illustrated in FIGS. 10 and 11, the tubular member 26 includes an annular groove 150 or release depression which is located below the teeth 134 to permit disengagement of the teeth 134 and grooves 146.

In operation, the liner hanger may be located at the top end of a liner and placed within a well bore. In such a position, the first cone 54, backing ring 126 and shear sleeve 90 are fixed relative to the tubular member by shear pins 60, 128 and 92, respectively. When the liner hanger 20 is actuated, the setting sleeve is pressed towards the second end relative to the tubular member 26 until the first cone 54 is engaged upon the first bracing sleeve 62 thereby searing the first shear pins 60 and engaging first collet. As the setting sleeve 30 member is pressed towards the second end 24, the sealing element 112 is compressed between the backing ring 126 and the first cone 54 until it is sufficiently in engagement upon the well bore wall at which pressure the second shear pins 128 are severed thereby sealing against well bore. The pressure for the second shear pins to be severed may be selected to be any pressure above the pressure to sever the first shear pins, however in practice it has been found that a force of between 5000 and 30,000 pounds force has been useful. Further movement of the setting sleeve 30 thereafter presses the second collet 70 onto the second cone 84 so as to extend the second arms 74 thereby fixing the bottom collet within the well bore.

When a user wishes to remove the liner hanger, a further force is applied to the tubular member 26 in a direction towards the first end 22 sufficient to shear the third shear pins 92 thereby releasing the shear sleeve 90 from the tubular member. The third shear pressure should be selected to be higher than the first and second shear pressures, and in practice it has been found that a pressure of between 5000 and 30,000 pounds force has been useful. To release the second collet from the well bore wall, the tubular member is further translated relative to the second collet 70 until the tubular member 26 is located relative to the setting sleeve 30 such that the release depression 150 below the teeth 134 and grooves 146 of the compression section thereby permitting radially inward movement of the teeth 134 of the arms 132 thereby disengaging the teeth 134 from the grooves 146 whereupon the retaining sleeve is permitted to move longitudinally towards the first end 22. Thereafter, the locating ring 94, which is located within an annular groove in the tubular member engages upon receptacle sleeve 140 or a portion of the second cone 84 whereafter the locating ring will pull the second cone 84 in a direction towards the first end 22 thereby disengaging the bore engaging surfaces 78 of the second collet 70 from the bore wall. After being disengaged, the second collet 70 will be freely movable relative to the well bore wall and may therefore fall down the well bore or along the liner for collection. Furthermore, it will be appreciated that once the collapsible section is collapsed as described above and illustrated in FIG. 11, the sealing element will no longer be compressed and will therefore be permitted to return to the retracted position illustrated in FIG. 6 and the first cone 54 will be permitted to slide towards the second end thereby permitting the first arms 44 to retract from the well bore side wall thereby disengaging the first collet 40. After being retracted from the well bore side wall, the locating ring 94 will maintain the second cone 84 at a position away from the second collet 70 and the retracting surface 69 will engage the first collet 40 to maintain it at a position away from the first cone 54 so as to prevent subsequent re-engagement of the collets and thereby to facilitate extraction.

While specific embodiments of the invention have been described and illustrated, such embodiments should be considered illustrative of the invention only and not as limiting the invention as construed in accordance with the above description.

What is claimed is:

1. An apparatus for suspending a liner within a bore comprising:

a central tubular member having a recess around an exterior surface thereof;

first and second sets of radially expandable arms, each set of arms expandable by corresponding longitudinally movable first and second cones spaced apart along said tubular member;

a seal located between said first and second sets of radially expandable arms and a selectably longitudinally compressible sleeve comprising a plurality of arms having teeth selectably engageable with grooves in a corresponding receptacle sleeve located between said first and second sets of radially expandable arms, wherein said end surfaces of said plurality of arms are maintained in engagement with said receptacle sleeve by said central tubular member, wherein said recess is located at a position along said central tubular member corresponding to a position at which said plurality of arms are desired to be released from engagement with said receptacle sleeve.

2. The apparatus of claim 1 wherein said first and second cones are selectably secured to said tubular member.

3. The apparatus of claim 2 wherein said first and second cones are selectably secured to said tubular member by shear pins.

4. The apparatus of claim 1 wherein said first set of radially expandable arms extends from a first common ring at a proximate end thereof and said second set of radially expandable arms extends from a second common ring at a proximate end thereof.

5. The apparatus of claim 1 wherein each of said first and second sets of radially expandable arms are expanded by pressing said first and second cones under distal ends of said radially expandable arms.

6. The apparatus of claim 1 wherein each of said first and second radially expandable arms includes a bracing sleeve extending from said proximate end of said radially expandable arms and having a distal end adapted to engage said first or second cone so as to prevent overexpansion of said arms.

7. The apparatus of claim 1 wherein said plurality of arms extend longitudinally from a ring extending around said tubular member.

8. The apparatus of claim 7 wherein said plurality of arms extend towards said second set of radially expandable arms.

9. The apparatus of claim 8 wherein said receptacle sleeve extends from a location proximate to said second set of radially expandable arms.

10. The apparatus of claim 9 wherein said receptacle sleeve extends between first and second ends wherein said first end overlies end surfaces of said plurality of arms and wherein said second end is proximate to said second cone corresponding to said second set of radially expandable arms.

11. The apparatus of claim 1 wherein said seal comprises a tubular seal element extending between first and second ends, said tubular seal being located around said central tubular member.

12. The apparatus of claim 11 wherein said seal element includes end walls located around said first and second ends of said seal element.

13. The apparatus of claim 12 wherein said end walls overlap a portion of said seal element.

14. The apparatus of claim 1 wherein said first set of radially expandable arms is slidable along said central tubular member from an initial position towards said second set of radially expandable arms.

15. The apparatus of claim 1 wherein said second set of radially expandable arms are secured to said central tubular member.

* * * * *